United States Patent [19]

Narasimhan et al.

[11] Patent Number: 4,563,330

[45] Date of Patent: Jan. 7, 1986

[54] SAMARIUM-COBALT MAGNET ALLOY CONTAINING PRASEODYMIUM AND NEODYMIUM

[75] Inventors: Kalatur S. V. L. Narasimhan, Monroeville; Francis S. Snyder, Coraopolis, both of Pa.

[73] Assignee: Crucible Materials Corporation, Pittsburgh, Pa.

[21] Appl. No.: 538,026

[22] Filed: Sep. 30, 1983

[51] Int. Cl.[4] ..... C22C 19/07

[52] U.S. Cl. ..... 420/435; 148/31.55

[58] Field of Search ..... 148/31.57; 420/435

[56] References Cited

U.S. PATENT DOCUMENTS

| | | | |
|---|---|---|---|
| 3,682,714 | 8/1972 | Martin | 148/31.57 |
| 3,821,035 | 6/1974 | Martin | 148/31.57 |
| 4,047,982 | 9/1977 | Sagawa et al. | 420/435 |
| 4,063,971 | 12/1977 | Greinacher et al. | 148/31.57 |
| 4,144,105 | 3/1979 | Gaiffi et al. | 420/435 |
| 4,382,061 | 5/1983 | Herget et al. | 148/31.57 |

FOREIGN PATENT DOCUMENTS

| | | | |
|---|---|---|---|
| 0046075 | 2/1982 | European Pat. Off. | 420/435 |

*Primary Examiner*—John P. Sheehan

*Attorney, Agent, or Firm*—Finnegan, Henderson, Farabow, Garrett & Dunner

[57] ABSTRACT

A magnet alloy which has a combination of high energy product and remanence, which magnet alloy consists essentially of, in weight percent, 10 to 30 samarium, 10 to 20 of an additional rare earth element selected from the group consisting of praseodymium and neodymium and the balance cobalt; iron and tin may also be added to the alloy.

1 Claim, No Drawings

SAMARIUM-COBALT MAGNET ALLOY CONTAINING PRASEODYMIUM AND NEODYMIUM

Samarium cobalt magnets having an energy product ($BH_{max}$) on the order of 20 MGOe may be commercially produced. When, however, an energy product of about 20 MGOe or somewhat higher is required the samarium-cobalt magnets must be subjected to closely controlled processing and the constituents must have an extremely low oxygen content. This adds significantly to the final cost of the magnet. Since samarium is the sole rare earth element used in magnets of this type this further adds to the final cost of the magnet, as samarium is a relatively expensive alloying addition.

Any improvement in energy product is related to improving the remanence value of the magnet, which in turn is related to the maximum saturation induction that can be achieved with a magnet alloy. Saturation induction is the maximum flux that can be produced in a magnet.

It is accordingly a primary object of the present invention to provide a magnet alloy wherein an energy product of above 20 MGOe may be achieved without requiring low oxygen content or special controlled processing and without requiring that samarium be used as the sole rare earth element of the rare earth cobalt magnet alloy.

A more specific object of the present invention is to provide a rare earth magnet alloy of this type wherein praseodymium, neodymium, or a combination thereof is substituted for a portion of the samarium.

Yet another object of the invention is the addition of iron and tin to a rare earth magnet alloy containing samarium, praseodymium and/or neodymium.

These and other objects of the invention, as well as a more complete understanding thereof, will be apparent from the following description and specific examples.

In accordance with the present invention the magnet alloy consists essentially of, in weight percent, 10 to 30 samarium and 10 to 20 of an additional rare earth element which may be praseodymium, neodymium or a combination thereof. The addition of neodymium or praseodymium either alone or in combination improves the saturation induction of the rare earth cobalt magnet when combined with the rare earth element samarium. Therefore, the magnet alloy containing praseodymium and/or neodymium will produce as a result of higher saturation induction improved, higher energy product and remanence.

A significant factor in improving energy product and remanence is to control grain size. More specifically, during the sintering operation incident to consolidation of the alloy powder into a magnet, grain growth and shrinkage occur, both of which result in higher density and thus improved energy product and remanence. On the other hand, if grain growth is excessive such will result in a lowering of coercive force. It has been found in accordance with the present invention that the required grain growth during sintering may be achieved if substantially equal portions of iron and tin are added to the powdered alloy in an amount each within the range of 0.5 to 2% by weight. The presence of tin during sintering promotes densification and iron controls the geometry of the crystal growth during sintering so that the combined effect of iron and tin is to inhibit grain growth during sintering.

EXAMPLE I

An alloy of the composition, in weight percent, 14.6 samarium, 12.8 praseodymium, 8.9 neodymium and the balance cobalt was cast and the cast alloy was pulverized into −30 mesh powder. The powder was then ball milled into approximately 4 micron particle size and pressed in a magnetic field wherein the magnetic field was maintained perpendicular to the pressing direction, which may be termed cross-field alignment. After pressing and sintering to achieve densification, the magnets of the above-recited composition had the following magnetic properties:

| Sintering Temp. | Sample ID | $B_r$ G | $H_c$ Oe | $H_{ci}$ Oe | $BH_{max}$ MGOe | $H_k$ Oe |
|---|---|---|---|---|---|---|
| 1120° C. | A | 9,500 | 7,800 | 12,200 | 12.2 | 6,400 |
| | B | 9,000 | 6,600 | 12,700 | 17.6 | 5,600 |
| | C | 9,400 | 7,100 | 14,000 | 20.2 | 5,400 |
| | D | 8,600 | 2,300 | 2,600 | 11.2 | 1,500 |

As may be seen, sintering at 1120° C. resulted in an energy product for Samples A and C of approximately 20 MGOe in combination with high remanence ($B_r$).

EXAMPLE II

The alloy used in Example I was ball milled with 0.5% of iron and tin in equal proportions to achieve about 4 micron particle size powder. The powder was then pressed and sintered at 1120° C. as in Example I. The magnetic properties of the magnets so produced were as follows:

| Sintering Temp | Sample ID | $B_r$ G | $H_c$ Oe | $H_{ci}$ Oe | $BH_{max}$ MGOe | $H_k$ Oe |
|---|---|---|---|---|---|---|
| 1120° C. | E | 9,400 | 8,400 | 15,100 | 21.6 | 8,300 |
| | F | 9,000 | 8,600 | 17,700 | 19.5 | 9,800 |
| | G | 9,000 | 8,400 | 16,100 | 19.4 | 10,000 |
| | H | 9,100 | 8,600 | 17,000 | 20.2 | 10,200 |

It may be seen that with the addition of iron and tin to the alloy the higher energy product and remanence values were present with all four samples. This indicates that with the addition of iron and tin to the alloy of Example I more consistent and more reproducible high energy product and remanence values may be achieved.

EXAMPLE III

The magnets of Example II were heated to 1100° C. for one hour, cooled to 912° C. and quenched to room temperature. The results are as follows:

| Heat Treatment | Sample ID | $B_r$ G | $H_c$ Oe | $H_{ci}$ Oe | $BH_{max}$ MGOe | $H_k$ Oe |
|---|---|---|---|---|---|---|
| 1100° C. - 1 hr cooled to 912° C. and quenched | F | 9,200 | 8,700 | 11,400 | 21.2 | 9,400 |
| | G | 9,100 | 8,400 | 11,200 | 20.2 | 8,400 |

As may be seen, this heat treatment did not improve the magnetic properties.

EXAMPLE IV

The magnet alloy of Example II containing iron and tin was processed similar to Example II except that it was pressed with the magnet field parallel to the pressing direction which is termed axial field alignment. The magnetic properties of the magnets were as follows:

| Sintering Temp. | Sample ID | $B_r$ G | $H_c$ Oe | $H_{ci}$ Oe | $BH_{max}$ MGOe | $H_k$ Oe |
|---|---|---|---|---|---|---|
| 1120° C. | A | 8,300 | 8,000 | 20,000+ | 17.2 | 10,600 |
| | B | 8,300 | 7,600 | 20,000+ | 16.8 | 7,600 |
| | C | 8,025 | 7,600 | 20,000+ | 15.5 | 8,800 |

This axial pressing did not result in improvement with respect to energy product and remanence values over that achieved by the combination of praseodymium and neodymium with samarium when the alloy was subjected to cross-field alignment as in Example I; however, the values obtained are better than conventionally achieved solely with samarium in combination with cobalt produced by axial pressing. Specifically, in samarium-cobalt alloys a $B_r$ of 8,000G and a $BH_{max}$ of 16 MGOe is typically achieved. The magnet Samples B and C were further heated to 1100° C. for one hour, cooled to 912° C. and quenched to room temperature. The magnetic properties after quenching were as follows:

| Treatment | Sample ID | $B_r$ G | $H_c$ Oe | $H_{ci}$ Oe | $BH_{max}$ MGOe | $H_k$ Oe |
|---|---|---|---|---|---|---|
| 1100° C. - 1 hr cooled to 912° C. and quenched | B | 8,300 | 8,000 | 14,000+ | 17 | 9,400 |
| | C | 8,100 | 7,900 | 17,200+ | 16.4 | 10,100 |

This second heat treatment resulted in an improvement from the standpoint of the $H_k$ values.

To determine the amount of Fe—Sn required an alloy of praseodymium, neodymium, samarium and cobalt was sintered with varying amounts of iron-tin. The results are as follows:

| % Fe—Sn | $B_r$ G | $H_c$ Oe | $H_{ci}$ Oe | $BH_{max}$ MGOe |
|---|---|---|---|---|
| 0.25 | 9,175 | 5,800 | 9,200 | 13.60 |
| 0.50 | 9,050 | 7,500 | 14,500 | 20.16 |
| 0.75 | 9,150 | 6,300 | 9,200 | 19.3 |
| 1.00 | 9,200 | 7,000 | 10,200 | 19.8 |

A maximum energy product value is achieved at 0.5% iron-tin addition.

An alloy of the composition, in weight percent, 20 samarium, 12 praseodymium, 4 neodymium and 64 cobalt was ball milled to a particle size of 3 to 5 microns and magnets were made which were sintered at 1125° C. The magnetic properties were as follows:

| Heat Treatment | $B_r$ G | $H_c$ Oe | $H_{ci}$ Oe | $BH_{max}$ MGOe | $H_k$ Oe |
|---|---|---|---|---|---|
| 1125° C. - 1 hr cool to 912° C. and quenched | 9,400 | 8,900 | 15,700 | 21.4 | 12,500 |

If the heat treatment included aging then the magnetic properties were as follows:

| Heat Treatment | $B_r$ C | $H_c$ Oe | $H_{ci}$ Oe | $BH_{max}$ MGOe | $H_k$ Oe |
|---|---|---|---|---|---|
| 1125° C. - 1 hr cool to 912° C. and quenched | 9,500 | 7,500 | 8,400 | 21.1 | 8,400 |

We claim:

1. A magnet alloy consisting essentially of, in weight percent, 10 to 30 samarium, total 10 to 21.7 of praseodymium and neodymium, 0.5 to 2 total of equal amounts of iron and tin and balance cobalt.

* * * * *